US007506572B1

(12) United States Patent
Hombeck

(10) Patent No.: US 7,506,572 B1
(45) Date of Patent: Mar. 24, 2009

(54) COMBINATION SABOT AND LAUNCH SEAL

(75) Inventor: William Donald Hombeck, Warwick, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 348 days.

(21) Appl. No.: 11/398,741

(22) Filed: Mar. 27, 2006

(51) Int. Cl.
*F41F 3/077* (2006.01)
*F41F 3/07* (2006.01)

(52) U.S. Cl. ..... 89/31; 89/30; 89/1.81; 89/1.817

(58) Field of Classification Search ..... 89/31, 89/30, 1.809, 1.81, 1.817; 114/238; 102/520
See application file for complete search history.

(56) References Cited

U.S. PATENT DOCUMENTS 44,631 A * 10/1864 Hull ..... 89/5
45,020 A * 11/1864 Cleu ..... 89/31
587,731 A * 8/1897 Hammer ..... 89/31
3,362,291 A * 1/1968 Deluca ..... 89/1.817
4,301,708 A 11/1981 Mussey
4,433,848 A * 2/1984 Williams ..... 277/547
4,485,719 A * 12/1984 Mendelsohn et al. ..... 89/1.816
4,498,368 A 2/1985 Doane
4,970,937 A * 11/1990 Ward ..... 89/1.817
5,062,345 A 11/1991 Tegel et al.
6,123,005 A 9/2000 Kuchta et al.
6,311,604 B1 11/2001 Foris et al.
6,427,574 B1 8/2002 Callahan

* cited by examiner

*Primary Examiner*—Stephen M Johnson
(74) *Attorney, Agent, or Firm*—James M. Kasischke; Jean-Paul A. Nasser; Michael P. Stanley

(57) ABSTRACT

A combination sabot and launch seal is taught that is made from a single piece of molded flexible material mounted to the interior of a launch capsule. The sabot portion of the invention is defined by multiple flexible appendages that are joined together at one end in a domed shape and positioned over the nose of a missile in a launch capsule. During a launch, the appendages separate and fold back over the lip of the forward aperture of the launch capsule.

6 Claims, 4 Drawing Sheets

COMBINATION SABOT AND LAUNCH SEAL

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

Not applicable.

BACKGROUND OF THE INVENTION (1) Field of the Invention

The present invention relates to missile launchers and more specifically to a combination sabot and launch seal for use in underwater launch capsules.

(2) Description of the Prior Art

The use of sabots and launch seals are necessary to the function of certain types of underwater missile launching systems. Sabots in particular protect launch capsule closures from external water pressure and launch seals are necessary to seal in thrust gases to properly expel the missiles at launch. In the prior art, sabots are seated directly above the nose cone of a missile and are used to provide increased bearing area and smoother curvature than the nose of a missile. The smooth curvature and increased bearing area prevents sea pressure applied to the forward closure assembly of the launch capsule from rupturing the forward closure's flexible membranes over the nose of the missile. In the prior art, launch seals are annular shaped flexible gasket devices that surround a missile while it is seated in the launch capsule. The launch seal contains the gas pressure used to expel the missile upon launch.

Prior art sabots are made from a solid brittle composite material that fragments during missile launch. This fragmentation can present a problem in certain types of submarines in which there are several launch capsules in a single vertical missile tube. After a missile launch, the sabot fragments are prone to falling on the forward closure assemblies of the neighboring launch capsules. The sabot fragments can cause damage to neighboring missiles as they are launched or can create a leak in the forward closure assembly of neighboring launch capsules, which could inhibit missile launch. The sabot fragments could also foul the missile tube hatch preventing watertight closure of the hatch. This condition would pose an unacceptable "safety of ship" situation. What is therefore needed is a device that performs the protective function of the prior art sabot but that does not generate foreign object fragments that could fall on to adjacent launch capsules.

SUMMARY OF THE INVENTION

It is a general purpose and object of the present invention to provide a sabot for use in a missile launch capsule that does not fragment upon missile launch, generating foreign object debris after the missile is expelled from the launch capsule.

This object is accomplished with the present invention by providing a single piece combination sabot and launch seal that is made from a molded flexible material. The combination sabot and launch seal is coupled to the interior of the launch capsule and integrated with the forward closure assembly. The sabot portion of the invention is defined by multiple flexible appendages that are joined together at one end in a domed shape and positioned over the nose of a missile in a launch capsule in the same way that prior art sabots are positioned. During a launch, the appendages separate and fold back over the lip of the launch capsule forward aperture.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
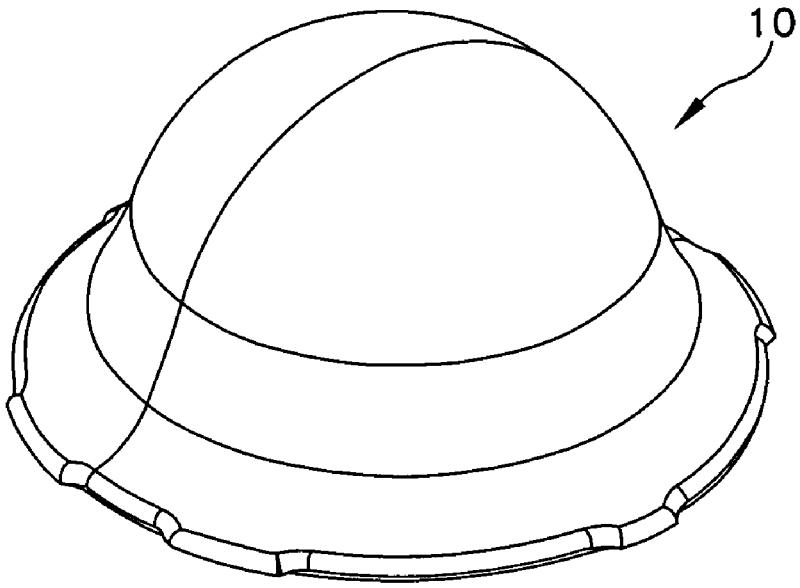
FIG. 1 (PRIOR ART)
FIG. 1 shows a prior art sabot design.
Figure 2:
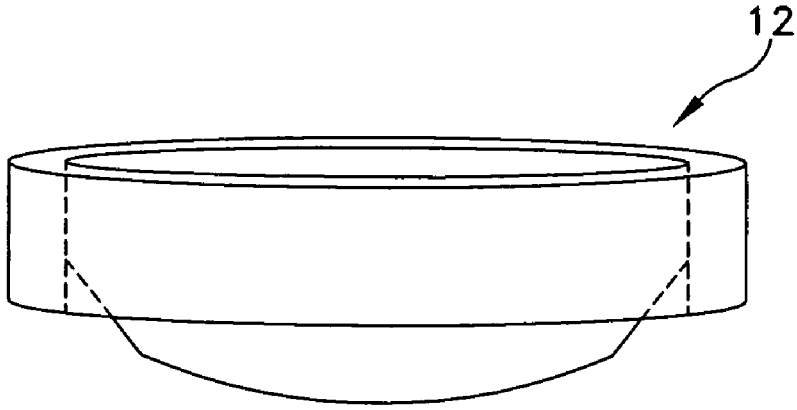
FIG. 2 (PRIOR ART)
FIG. 2 shows a prior art launch seal.
Figure 3:
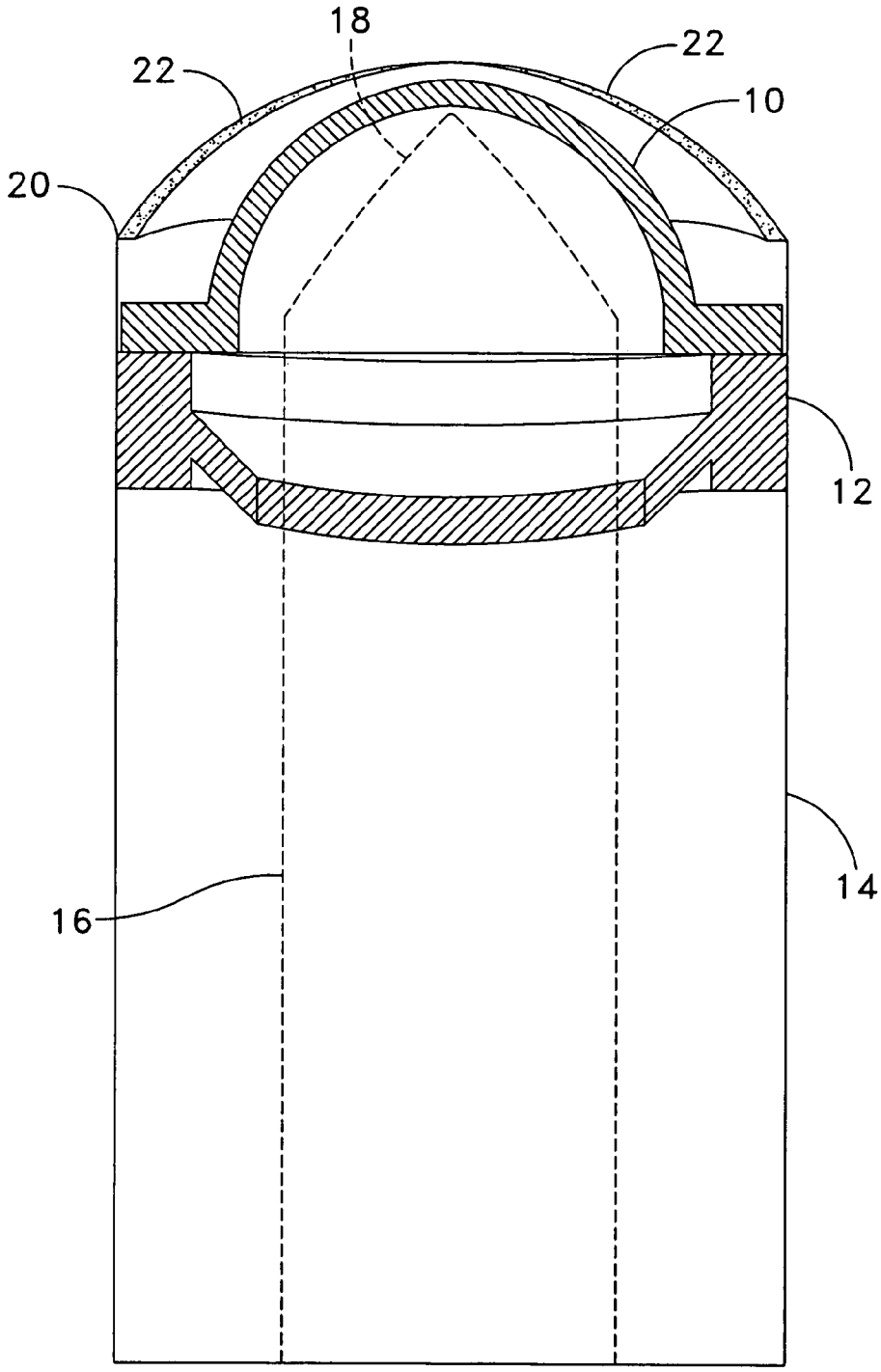
FIG. 3 (PRIOR ART)
FIG. 3 shows a cross sectional view of the prior art sabot and launch seal inside a launch capsule.

Referring to FIG. 1, there is shown a prior art sabot 10 designed with a curved dome geometry and made of a solid brittle composite material. Referring to FIG. 2 there is shown a prior art launch seal 12 designed essentially as a gasket seal with an annular flap extending within the ring and made of a flexible urethane material. Referring to FIG. 3, there is shown a cross sectional view of the prior art sabot 10 and launch seal 12 inside a launch capsule 14. The missile 16 is shown in phantom. The sabot 10 sits on the missile nose 18 to prevent sea pressure on the forward closure assembly 20 from tearing the flexible membranes 22 over the nose of the missile 18. The sabot 10 is installed between the missile nose 18 and the flexible membranes 22. The sabot 10 is only positioned on the missile nose 18 and is not fastened down in any way. During launch the missile 16 forces the flexible membranes 22 to rupture by forcing the sabot 10 upward through forward closure assembly. During this process the sabot 10 breaks apart into multiple fragments that fall away freely as the missile 16 exits the launch capsule 14.

Figure 4:
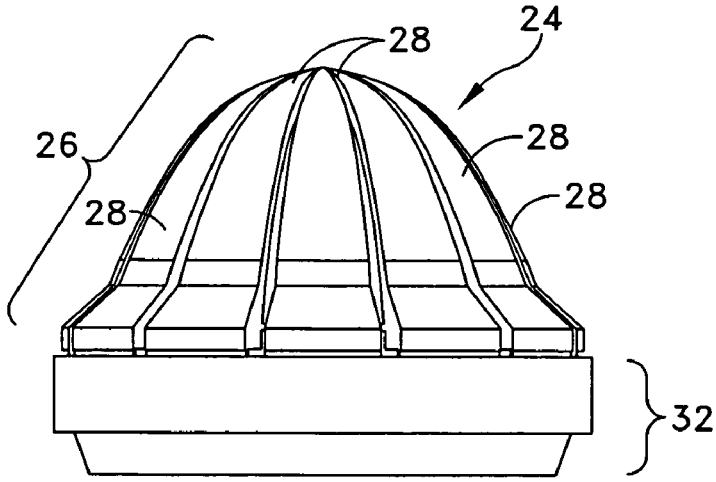
FIG. 4 shows a side view of the combined sabot and launch seal.

Referring to FIG. 4 there is shown a side view of the combined sabot and launch seal 24, a one piece device that performs both the launch seal function of containing gas pressure at launch and the sabot function of providing a protective larger smoother contoured surface than the nose of the missile 18 to support the flexible membranes 22 directly above it while under sea pressure. The sabot portion 26 is defined by multiple elastomeric support appendages 28 capable of being joined together at one end 30 to form a curved dome geometry similar to the prior art sabot 10 illustrated in FIG. 1. The launch seal portion 32 forms the base.

Figure 5:
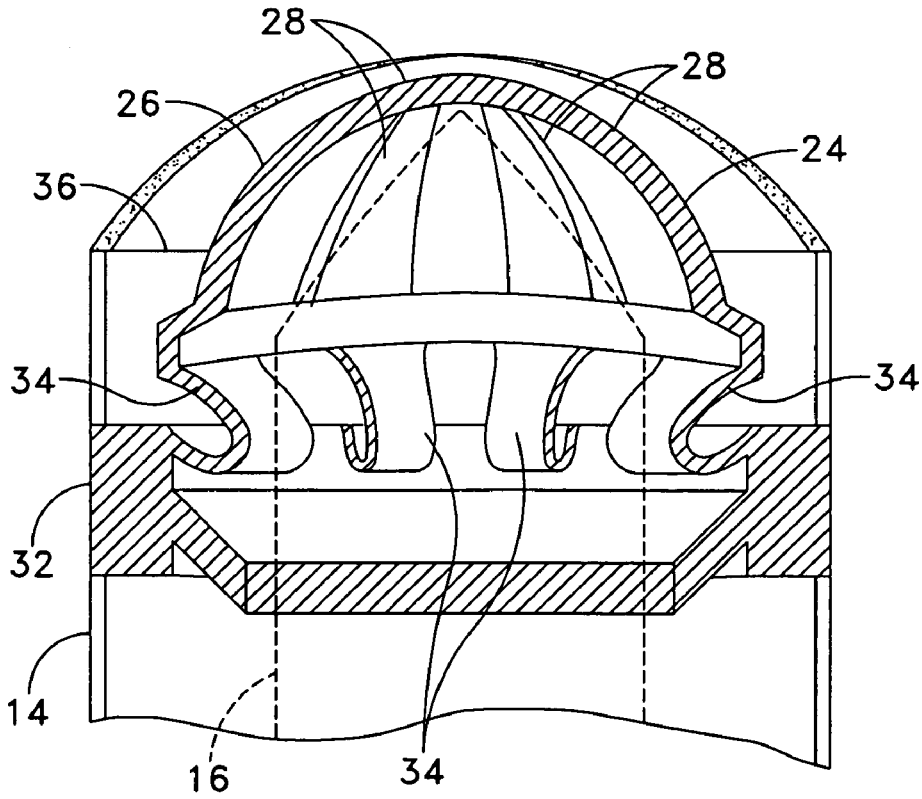
FIG. 5 shows a cross-sectional view of the invention installed in a launch capsule.
Figure 6:
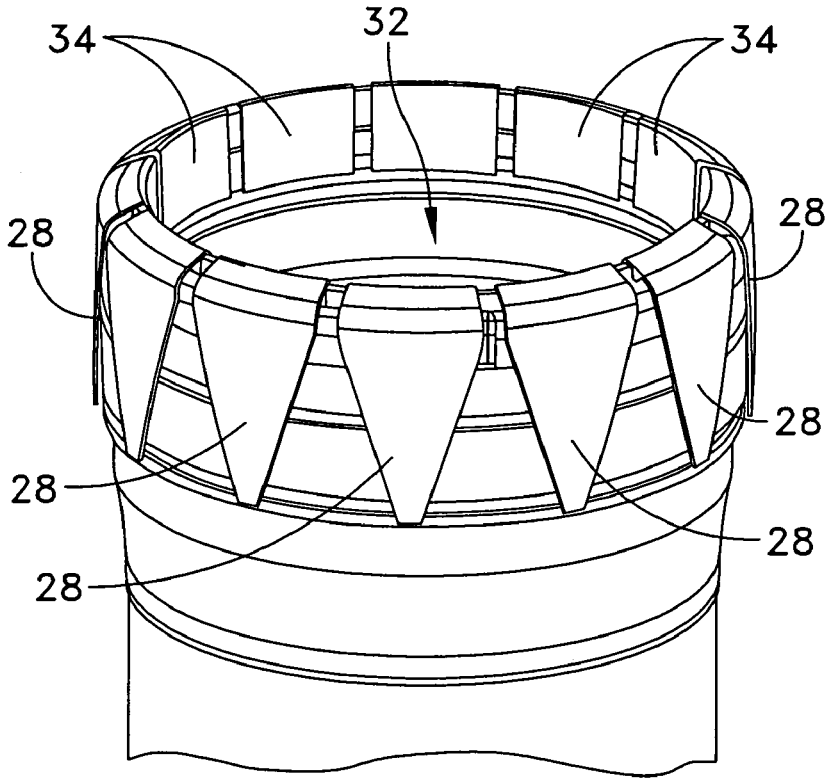
FIG. 6 shows a post missile launch view of the invention.

Referring to FIG. 5 there is shown a cross-sectional view of the combined sabot and launch seal 24 installed in a launch capsule 14. The missile 16 is shown in phantom. In a preferred embodiment the entire combined sabot and launch seal 24 is molded from a single mold of polyurethane, just as prior art launch seals 12 are molded from polyurethane. Other elastomeric materials could also be used to fabricate the invention 24. The sabot portion 26 is connected to the launch seal portion 32 by molded retaining straps 34 that link the two portions of the invention. The retaining straps 34 are designed to be in a folded position when molded. They are flexible enough, however, to unfold and stretch out to their full length when forced to. This ability to unfold and stretch out is what allows the sabot portion 26 to be retained to the launch capsule 14 after a missile launch. The launch seal portion 32 is attached to the interior of the launch capsule 14 with a powerful adhesive capable of holding the launch seal in place as the missile 16 is launched. During a launch the multiple elastomeric support appendages 28 of the sabot portion 26 are ruptured by the force of the exiting missile 16 and separate. Referring to FIG. 6 there is shown a view of the combined sabot and launch seal 24 after a missile launch. The torn flexible membranes 22 are not shown so that the invention can be seen in detail. The multiple elastomeric support appendages are separated and folded back over the lip of the launch capsule's forward aperture 36.

Figure 7:
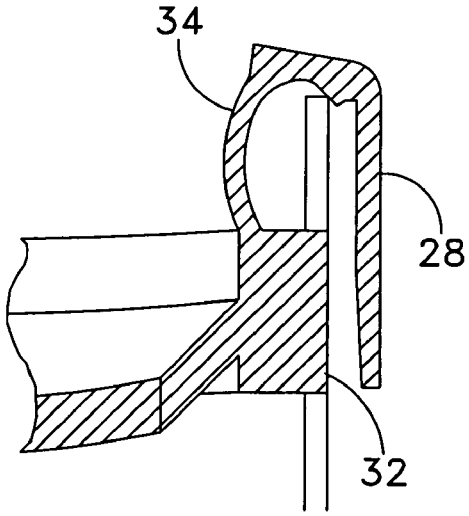
FIG. 7 shows a cutaway view of the retaining leash portion of the invention.

The cutaway view in FIG. 7 shows how the retaining straps 34 are unfolded and stretched to their entire length while retaining the sabot portion 26. This allows the sabot portion 26 of the invention to clear the outer lip of the forward aperture 36 of the launch capsule 14 to allow the missile 16 to pass through the forward aperture 36 while preventing the multiple elastomeric support appendages 28 of the sabot portion 26 from separating from the launch capsule 14 and potentially causing damage to adjacent launch capsules.

The advantages of the present invention over the prior art are that: The present invention provides a novel sabot and launch seal that will not produce foreign object debris that can interfere with the operation of the missile tube hatch.

What has thus been described is a combination sabot and launch seal that is made from a flexible material coupled to the forward closure assembly of a launch capsule. The sabot portion is defined by flexible appendages that are joined together at one end over the nose of a missile in a launch capsule. During a launch, the appendages separate and fold back over the lip of the forward closure assembly of the launch capsule.

Obviously many modifications and variations of the present invention may become apparent in light of the above teachings. For example: the elastomeric material from which the combination sabot and launch seal is fashioned could be synthetic rubber, plastic, or any other suitably flexible material.

In light of the above, it is therefore understood that within the scope of the appended claims, the invention may be practiced otherwise than as specifically described.

What is claimed is:

1. A combination sabot and launch seal for use in a missile launch capsule capable of launching a missile from beneath the surface of a body of water, comprising:

a sabot portion defined by a plurality of elastomeric support appendages that are joined together at one end to form a curved dome geometry;

a launch seal portion that is annular shaped with an annular flap extending from within said annular shaped launch seal; and a plurality of retaining straps that join said plurality of elastomeric support appendages of said sabot portion to said launch seal portion.

2. The combination sabot and launch seal of claim 1 wherein said launch seal portion is attached to the interior of the launch capsule by a powerful adhesive capable of holding the launch seal in place as a missile is launched from the launch capsule.

3. The combination sabot and launch seal of claim 1 wherein said retaining straps are in a folded position when molded, but are flexible enough to unfold and stretch out to their full length thereby allowing the sabot portion to be retained to the launch capsule after a missile launch.

4. The combination sabot and launch seal of claim 1 wherein the entire combined sabot and launch seal is a single molded apparatus molded from a single mold of polyurethane.

5. The combination sabot and launch seal of claim 1 wherein during a launch the multiple elastomeric support appendages of the sabot portion are ruptured by the force of the exiting missile, separate and fold back over the lip of the launch capsule's forward aperture.

6. A combination sabot and launch seal for use in a missile launch capsule capable of launching a missile from beneath the surface of a body of water, comprising:

a sabot portion defined by a plurality of elastomeric support appendages that are joined together at one end to form a curved dome geometry;

a launch seal portion that is annular shaped with an annular flap extending from within said annular shaped launch seal, wherein said launch seal portion is attached to the interior of the launch capsule by a powerful adhesive capable of holding the launch seal in place as a missile is launched from the launch capsule;

a plurality of retaining straps that join said plurality of elastomeric support appendages of said sabot portion to said launch seal portion;

wherein the entire combined sabot and launch seal is a single molded apparatus molded from a single mold of polyurethane;

wherein said retaining straps are in a folded position when molded, but are flexible enough to unfold and stretch out to their full length thereby allowing the sabot portion to be retained to the launch capsule after a missile launch; and wherein during a launch the multiple elastomeric support appendages of the sabot portion are ruptured by the force of the exiting missile, separate and fold back over the lip of the launch capsule's forward aperture.

* * * * *